US006052040A

United States Patent [19]

Hino

[11] Patent Number: 6,052,040

[45] Date of Patent: Apr. 18, 2000

[54] DIELECTRIC DUPLEXER WITH DIFFERENT CAPACITIVE COUPLING BETWEEN ANTENNA PAD AND TRANSMITTING AND RECEIVING SECTIONS

[75] Inventor: Seigo Hino, Ise, Japan

[73] Assignee: NGK Spark Plug Co., Ltd., Japan

[21] Appl. No.: 09/033,160

[22] Filed: Mar. 2, 1998

[30] Foreign Application Priority Data

Mar. 3, 1997 [JP] Japan ..... 9-065325

[51] Int. Cl.[7] ..... H01P 5/12

[52] U.S. Cl. ..... 333/134; 333/206

[58] Field of Search ..... 333/132, 126, 333/129, 134, 202, 206, 207

[56] References Cited

U.S. PATENT DOCUMENTS

| | | | |
|---|---|---|---|
| 5,146,193 | 9/1992 | Sokola | 333/206 |
| 5,150,089 | 9/1992 | Komazaki et al. | 333/206 |
| 5,250,916 | 10/1993 | Zakman | 333/206 |
| 5,406,236 | 4/1995 | Newell et al. | 333/206 |
| 5,512,866 | 4/1996 | Vangala et al. | 333/206 X |
| 5,831,497 | 11/1998 | Yorita et al. | 333/206 X |

FOREIGN PATENT DOCUMENTS

| | | |
|---|---|---|
| 0 654 841 | 5/1995 | European Pat. Off. . |
| 0 654 842 | 5/1995 | European Pat. Off. . |
| 62-169502 | 7/1987 | Japan . |
| 62-169503 | 7/1987 | Japan . |
| 1-105203 | 7/1989 | Japan . |

OTHER PUBLICATIONS

Patent Abstracts of Japan; vol. 95, No. 9, Oct. 31, 1995 & JP 07 147505A (Murata Mfg Co Ltd), Jun. 6, 1995 * abstract; Figure 5B *.

Patent Abstracts of Japan; vol. 97, No. 1, Jan. 31, 1997 & JP 08 228103A (Murata Mfg Co Ltd), Sep. 3, 1996 * abstract *.

*Primary Examiner*—Seungsook Ham
*Attorney, Agent, or Firm*—Larson & Taylor LLP

[57] ABSTRACT

A compact and highly effective dielectric duplexer comprises a dielectric ceramic block and a plurality of resonators arranged in a direction in the dielectric ceramic block, a half of the resonators constituting a transmitting section T, the remaining half of the resonators constituting a receiving section R, wherein an antenna terminal pad is capacitively coupled to the innermost resonator of the transmitting section T and to the innermost resonator of the receiving section R located adjacent to the innermost resonator to eliminate the use of a wave-dividing resonator, whereby the dielectric ceramic block can be dimensionally reduced in the direction along which resonators are arranged and hence it is adapted to down-sizing. Additionally, the coupling capacitance Ct of the antenna terminal pad and the transmitting section T is made greater than the coupling capacitance Cr of the antenna terminal pad and the receiving section R, whereby a return loss is reduced in both the transmitting section T and the receiving section R to improve the signal transmitting performance and the signal receiving performance of the dielectric duplexer.

7 Claims, 10 Drawing Sheets

Relationship between Ct and Cr and the wave-dividng effect (in terms of return loss) (calculated)

| | (a) | (b) | (c) | (d) |
|---|---|---|---|---|
| Ct (PF) | 2.0 | 2.0 | 2.0 | 1.0 |
| Cr (PF) | 1.0 | 1.5 | 2.0 | 2.0 |
| Tx |  |  |  |  |
| R.Loss (dB) | 16.3 | 7.7 | 3.0 | 3.0 |
| Rx |  |  |  |  |
| R.Loss (dB) | 16.2 | 6.0 | 3.7 | 3.7 |

DIELECTRIC DUPLEXER WITH DIFFERENT CAPACITIVE COUPLING BETWEEN ANTENNA PAD AND TRANSMITTING AND RECEIVING SECTIONS

BACKGROUND OF THE INVENTION

The present invention relates to a dielectric duplexer of a type to be used for a mobile telecommunication device such as a car telephone set or a portable telephone set.

FIG. 1 of the accompanying drawings illustrates a typical conventional dielectric duplexer of the type under consideration. The dielectric duplexer D comprises as essential components thereof a dielectric ceramic block B, resonators t1 through t3 and r1 through r3 formed in the dielectric ceramic block B by cutting through holes through the dielectric ceramic block B sequentially along a direction and covering the inner peripheral surfaces of the through holes with respective internal conductors. The resonators are divided into a group of resonators t1 through t3 located near a lateral side of the dielectric ceramic block B and operating as a transmitting section T and another group of resonators r1 through r3 located near the opposite lateral side of the dielectric ceramic block B and operating as a receiving section R. An external conductor is provided for covering the outer peripheral surface of the dielectric ceramic block B except an open-circuit end surface intended for exposing the through holes to the outside. An input/output pad Pt is arranged on the bottom surface of the dielectric ceramic block B to be brought into contact with a printed circuit board when being assembled, and electrically isolated from the external conductor but capacitively coupled to the outermost resonator t1. Another input/output pad Pr is arranged also on the bottom surface of the dielectric ceramic block B and electrically isolated from the external conductor but capacitively coupled to the outermost resonator r3. Further, an antenna terminal pad Pa is arranged also on the bottom surface of the dielectric ceramic block B and electrically isolated from the external conductor. A variety of dielectric duplexers of the above described type have been proposed.

The dielectric duplexer D of FIG. 1 additionally comprises a wave-dividing resonator S arranged between the transmitting section T including the resonators t1 through t3 and the receiving section R including the resonators r1 through r3 at a position corresponding to the antenna terminal pad Pa arranged on the bottom surface of the dielectric ceramic block B.

FIG. 2 is an equivalent circuit diagram of the dielectric duplexer D of FIG. 1.

With this arrangement, the wave-dividing resonator S is located at the middle of the dielectric ceramic block B and hence the latter is required to have a large width. This means that a completed dielectric duplexer is of large size.

It is, therefore, an object of the present invention to provide a dielectric duplexer having a reduced width to eliminate the above identified problem.

SUMMARY OF THE INVENTION

According to the invention, the above object is achieved by providing a dielectric duplexer of the above described type, wherein an antenna terminal pad is arranged on one surface of a dielectric ceramic block and electrically isolated from an external conductor but capacitively coupled to the innermost resonator of a transmitting section and the innermost resonator of the receiving section located adjacent to the innermost resonator of the transmitting section, and a coupling capacitance of the antenna terminal pad and the transmitting section is made greater than that of the antenna terminal pad and the receiving section. In other words, a dielectric duplexer according to the invention is free from a wave-dividing resonator and the antenna terminal pad is directly coupled to the transmitting section and the receiving section.

After a series of various experiments, the inventor of the present invention found that both the transmitting characteristic and the receiving characteristic of a dielectric duplexer is improved when the coupling capacitance Ct of the innermost resonator of the transmitting section and the antenna terminal pad and the coupling capacitance Cr of the innermost resonator of the receiving section and the antenna terminal pad show a relationship of Ct>Cr.

The relationship of Ct>Cr can be realized by arranging the antenna terminal pad closer to the transmitting section than to the receiving section so that the innermost resonator of the transmitting section is located relatively close to the antenna terminal pad to increase their coupling capacitance.

Alternatively, the relationship of Ct>Cr can be realized by displacing the innermost resonator of the transmitting section from the remaining resonators in a direction perpendicular to the line connecting the centers of the remaining resonators toward the surface of the dielectric ceramic block where the input/output terminal pads are located.

Still alternatively, the relationship of Ct>Cr can be realized by providing the antenna terminal pad with an enlarged portion located closer to the transmitter section than to the receiving section.

Now, the present invention will be described by referring to the accompanying drawings that illustrate preferred embodiments of the invention.

DESCRIPTION OF THE PREFERRED EMBODIMENTS OF THE INVENTION

Figure 1:
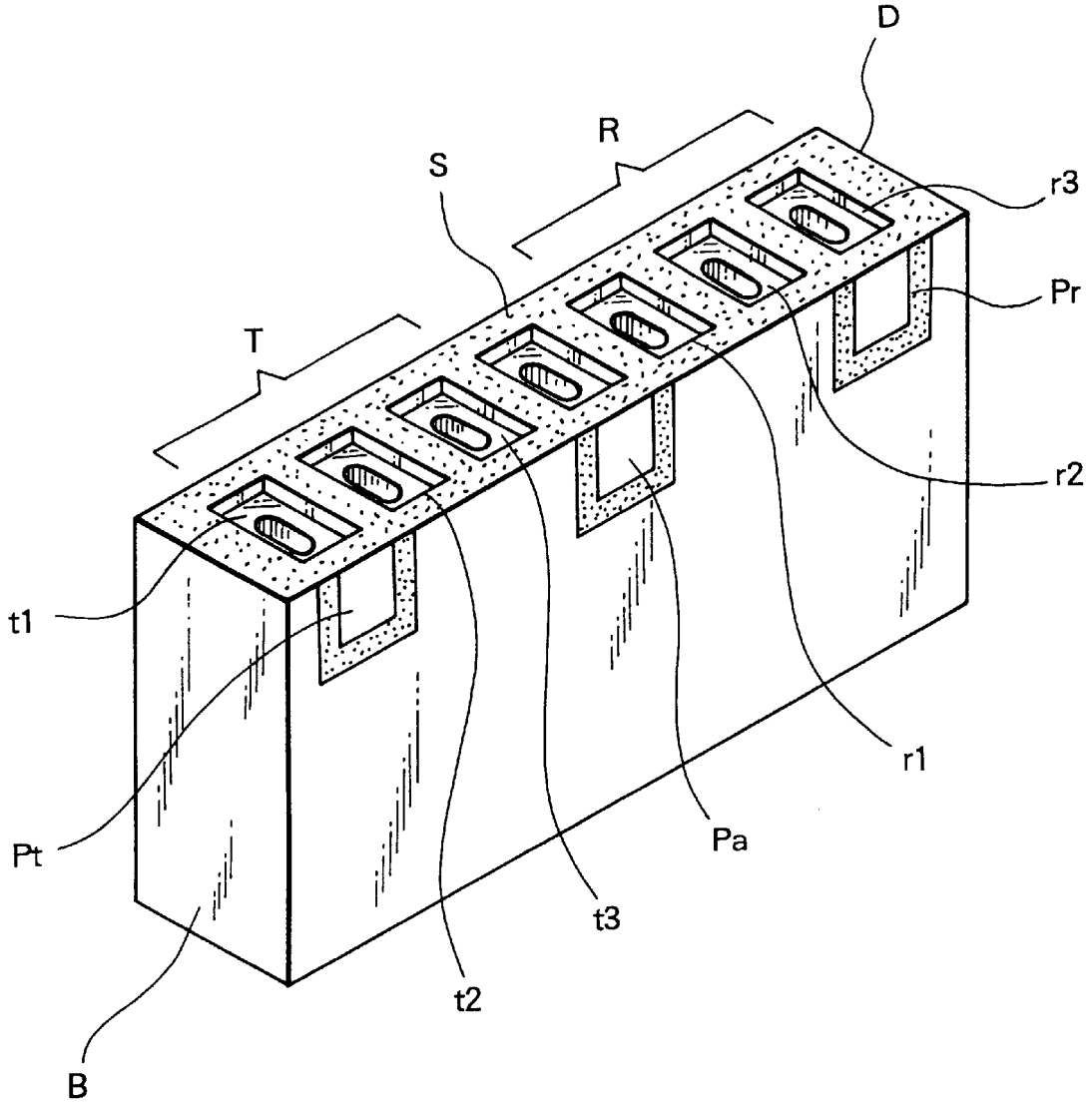
FIG. 1 PRIOR ART
FIG. 1 is a schematic perspective view showing a conventional dielectric duplexer.
Figure 2:
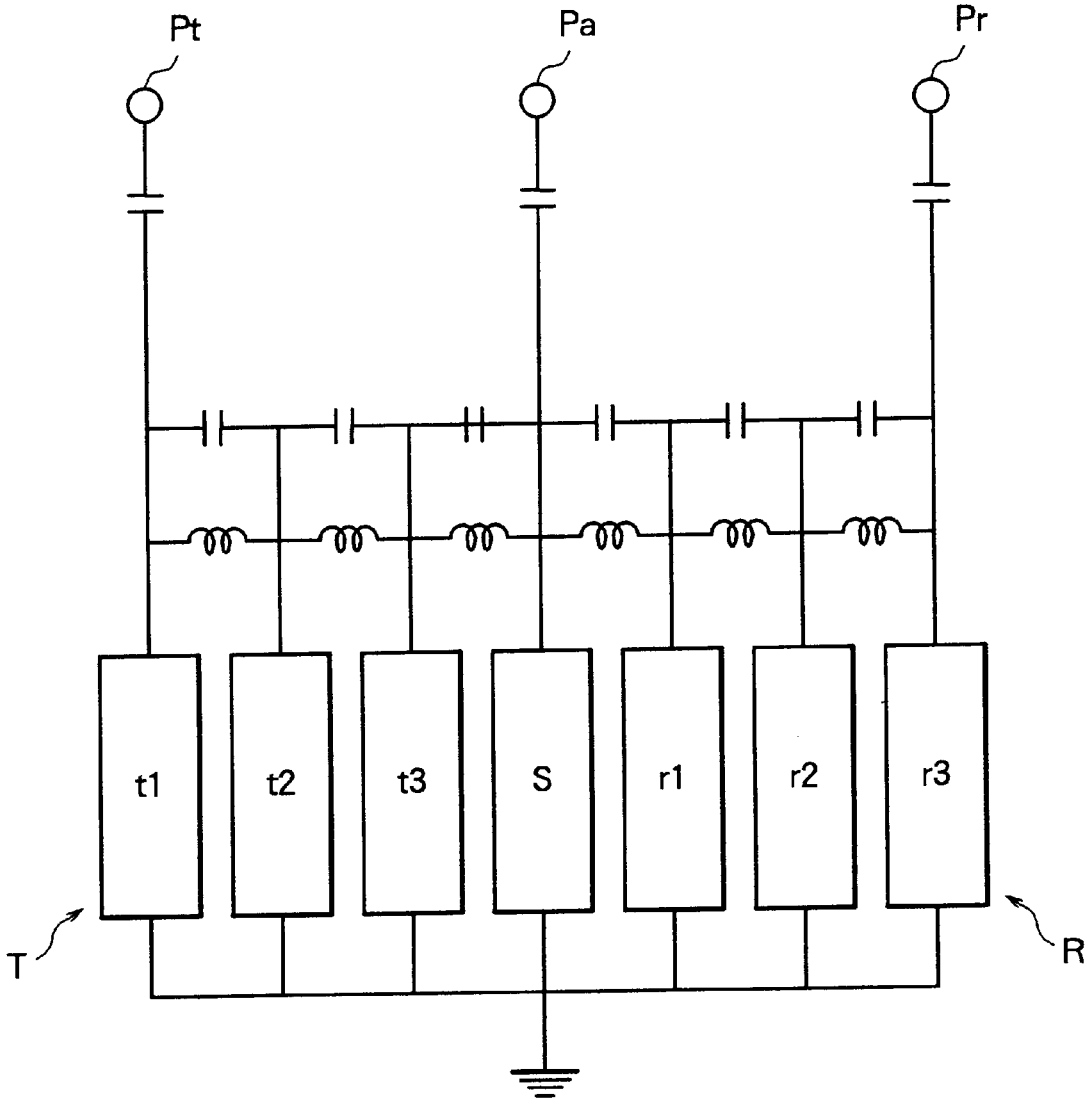
FIG. 2 PRIOR ART
FIG. 2 is an equivalent circuit diagram of the dielectric duplexer of FIG. 1.
Figure 3:
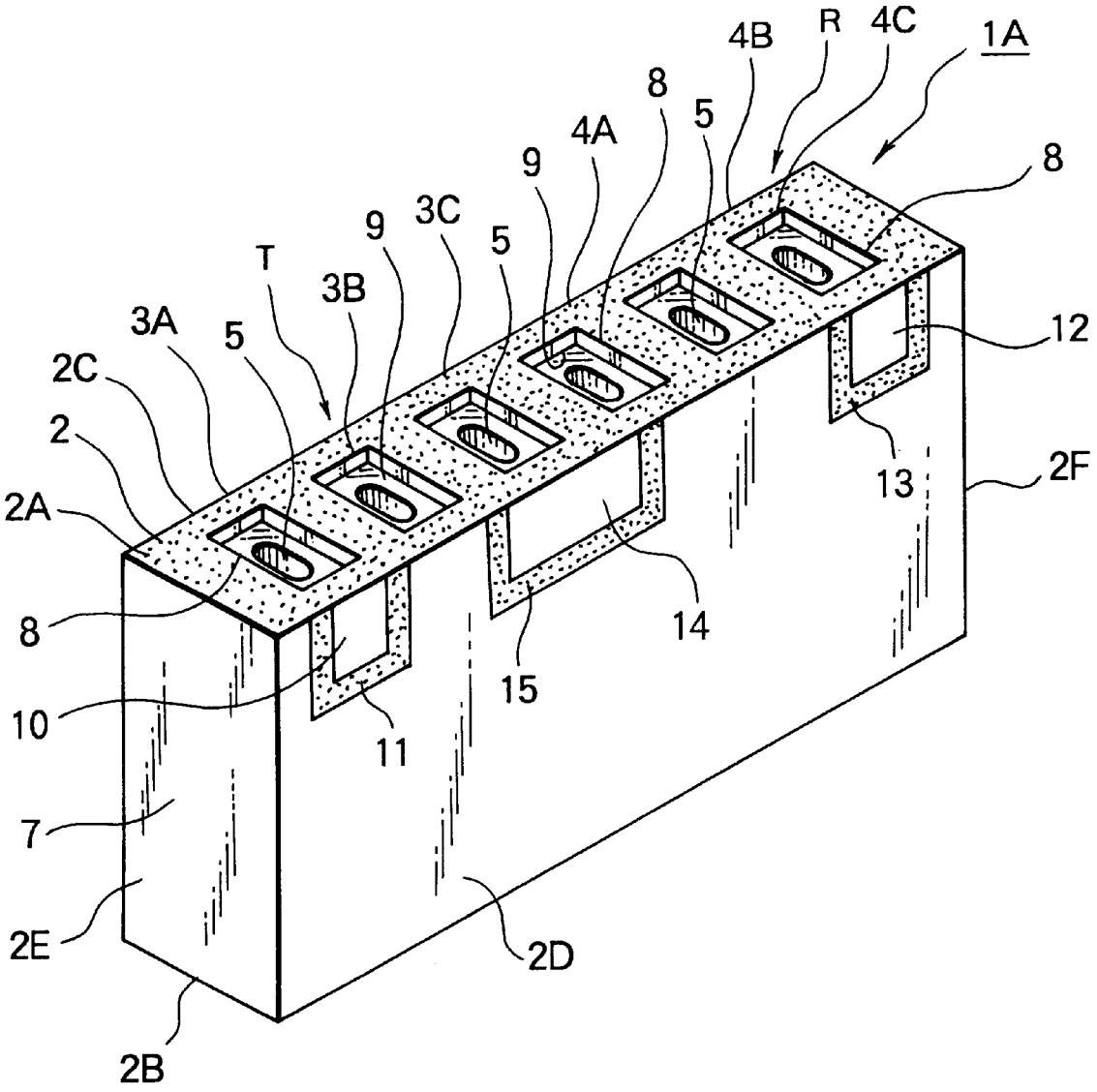
FIG. 3 is a schematic perspective view showing a dielectric duplexer according to a first embodiment of the present invention.

In the following description, the components that are common to the different embodiments are denoted respectively by the same reference numerals or symbols and will not be described duplicatively.

FIGS. 3 through 6 schematically illustrate a dielectric duplexer of the first embodiment of the present invention. The illustrated dielectric duplexer 1A comprises a dielectric ceramic block 2 having a flat and rectangularly parallelepipedic profile and a total of six resonators 3A, 3B, 3C and 4A, 4B, 4C arranged in the dielectric ceramic block 2. The dielectric ceramic block 2 has six outer peripheral surfaces 2A, 2B, 2C, 2D, 2E and 2F. The resonators 3A through 3C and 4A through 4C are arranged in parallel with the top and bottom surfaces 2C and 2D of the dielectric ceramic block 2, and are divided into a tripole-type transmitting section T including three resonators 3A, 3B, 3C and a tripole-type receiving section R including three resonators 4A, 4B, 4C.

The resonators 3A through 3C and 4A through 4C may be formed by cutting through holes 5 for them each of which extends from the front surface 2A to the rear surface 2B of the dielectric ceramic block 2 and applying respective internal conductors 6 to the inner peripheral surfaces of the through holes 5. Note that the through holes 5 have an elliptic cross section whose major axis is running in parallel with the lateral side surfaces 2E and 2F of the dielectric ceramic block 2. A predetermined area of the outer surfaces of the dielectric ceramic block 2 are covered with an external conductor 7 except the front surface 2A where the through holes 5 are exposed to the outside. The external conductor 7 thus provided forms a shield electrode, and the front surface 2A of the dielectric ceramic block 2 having no external conductor 7 forms an open-circuit end surface.

Each of the resonators 3A through 3C and 4A through 4C has a resonance length that corresponds to a quarter of their resonant frequency or $\lambda/4$.

On the open-circuit end surface 2A of the dielectric ceramic block 2, each of the resonators is provided with a rectangularly parallelepipedic coupling clearance 8 cut into the dielectric ceramic block 2 for coupling itself to the adjacent resonator(s). On the bottom of the clearance 8 is provided a spread conductor 9 which is electrically connected to the internal conductor 6 of the resonator so that desired coupling capacitances may be selected for the resonators 3A through 3C and 4A through 4C by selecting the locations and the longitudinal and transversal dimensions of the clearances 8. It should be noted that the coupling clearance 8 of the innermost resonator 3C of the transmitting section T and that of the innermost resonator 4A of the receiving section R are separated by a relatively large distance in order to reduce the coupling capacitance of the adjacently located resonator 3C and 4A as much as possible.

Meanwhile, an input/output pad 10 is formed on the bottom surface 2D of the dielectric ceramic block 2 vis-a-vis the outermost resonator 3A of the transmitting section T along the open-circuit end surface 2A of the block 2 and electrically isolated from the external conductor 7 by a space 11 but capacitively coupled to the resonator 3A.

Similarly, another input/output pad 12 is formed on the bottom surface 2D of the dielectric ceramic block 2 vis-a-vis the outermost receiver 4C of the receiving section R along the open-circuit end surface 2A of the block 2 and electrically isolated from the external conductor 7 by a space 13 but capacitively coupled to the resonator 4C.

Additionally, an antenna terminal pad 14 is formed also on the bottom surface 2D of the dielectric ceramic block 2 along the open-circuit end surface 2A thereof at a position located between the transmitting section T and the receiving section R and electrically isolated from the external conductor 7 by a space 15.

Figure 12:
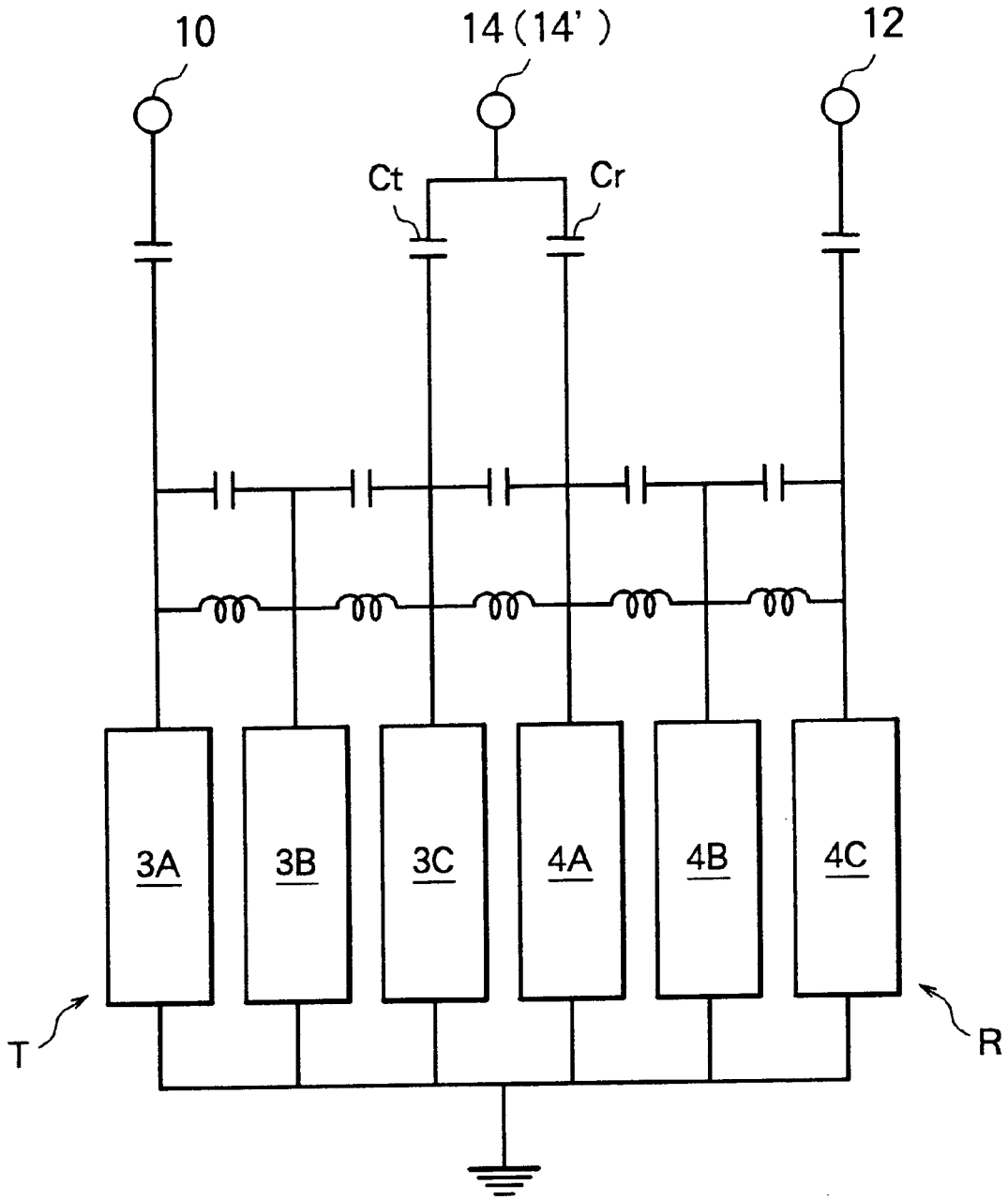
FIG. 12 is an equivalent circuit diagram of the dielectric duplexer according to the present invention.

The antenna terminal pad 14 has a large width so that it is capacitively coupled to both the innermost resonator 3C of the transmitting section T and the innermost resonator 4A of the receiving section R. As seen from the equivalent circuit of FIG. 12, the antenna terminal pad 14 is capacitively coupled to the resonators 3C and 4A, which resonators 3C and 4A are, however, not capacitively coupled directly.

As a result of a series of experiments using this arrangement, the inventor of the present invention found that the dielectric duplexer of the type under consideration operates excellently for signal transmission and reception when the coupling capacitance Ct of the innermost resonator 3C of the transmitting section T and the antenna terminal pad 14 and the coupling capacitance Cr of the innermost resonator 4A of the receiving section R and the antenna terminal pad 14 show a relationship of Ct>Cr.

Figure 13:
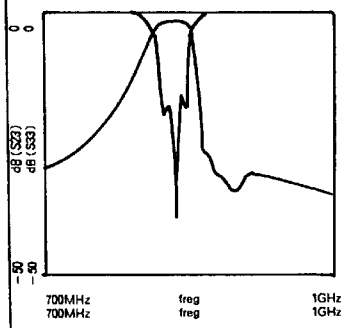
FIG. 13 is graphs showing the relationship between the coupling capacitances Ct and Cr and the attenuation characteristics of the dielectric duplexer according to the present invention.
Figure 13:
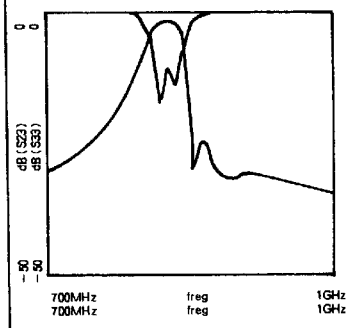
Figure 13:
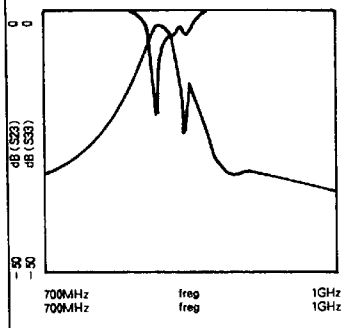
Figure 13:
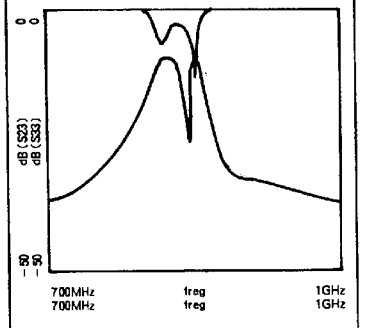

FIG. 13 shows graphs showing the relationship between the frequency and the attenuation of the dielectric duplexer according to the present invention observed when the antenna terminal pad 14 is positionally shifted to change both the coupling capacitance Ct and the coupling capacitance Cr. More specifically, the loss (or return loss) in the reflected wave was observed both at the transmitting section T and the receiving section R. It should be noted that the return loss at the transmitting section T shows the least attenuation evidenced by the waveform of the reflected wave within a range of resonant frequency $f_0$=836.5 MHz±12.5 MHz. Likewise the return loss at the receiving section R shows the least attenuation evidenced by the waveform of the reflected wave within a range of resonant frequency $f_0$=881.5 MHz±12.5 MHz.

From the graphs, it will be seen that a relationship of Ct>Cr holds true in graphs (a) and (b) of FIG. 13 and graph (c) of FIG. 13 shows a relationship of Ct=Cr, whereas graph (d) of FIG. 13 shows a relationship of Ct<Cr. Thus, the return loss will be increased in both the transmitting section T and the receiving section R to improve the characteristic or performance of the dielectric duplexer when Ct is far greater than Cr.

Now, various arrangements that give rise to the relationship of Ct>Cr will be described.

Figure 4:
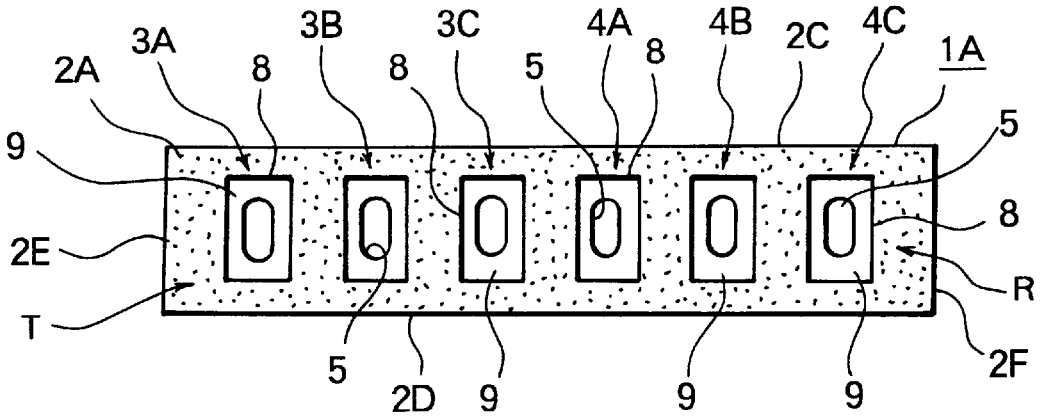
FIG. 4 is a schematic front view of the dielectric duplexer of FIG. 3.
Figure 5:
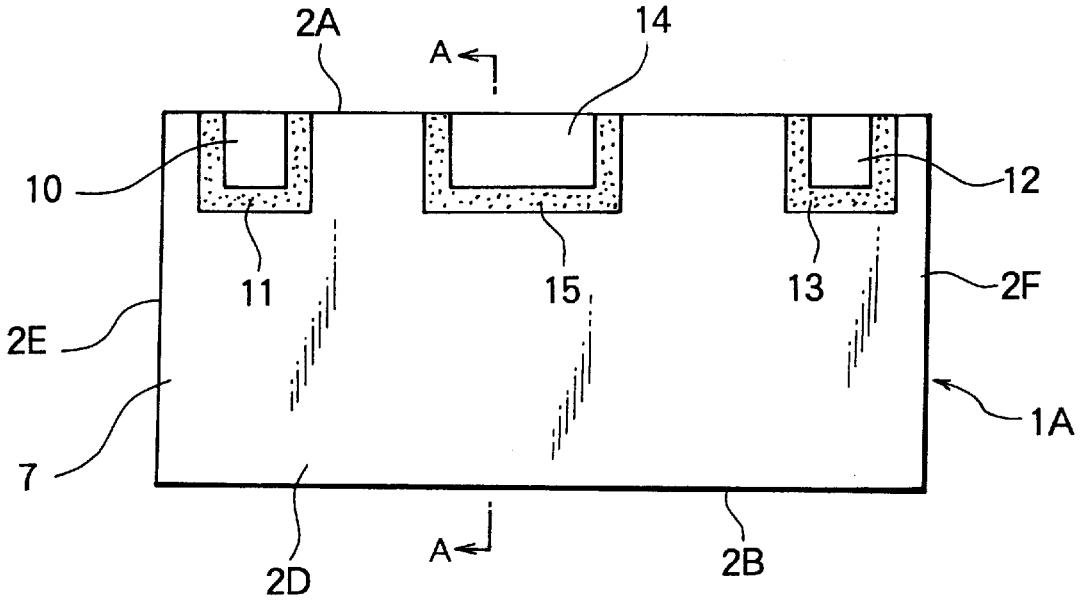
FIG. 5 is a schematic bottom view of the dielectric duplexer of FIG. 3.
Figure 6:
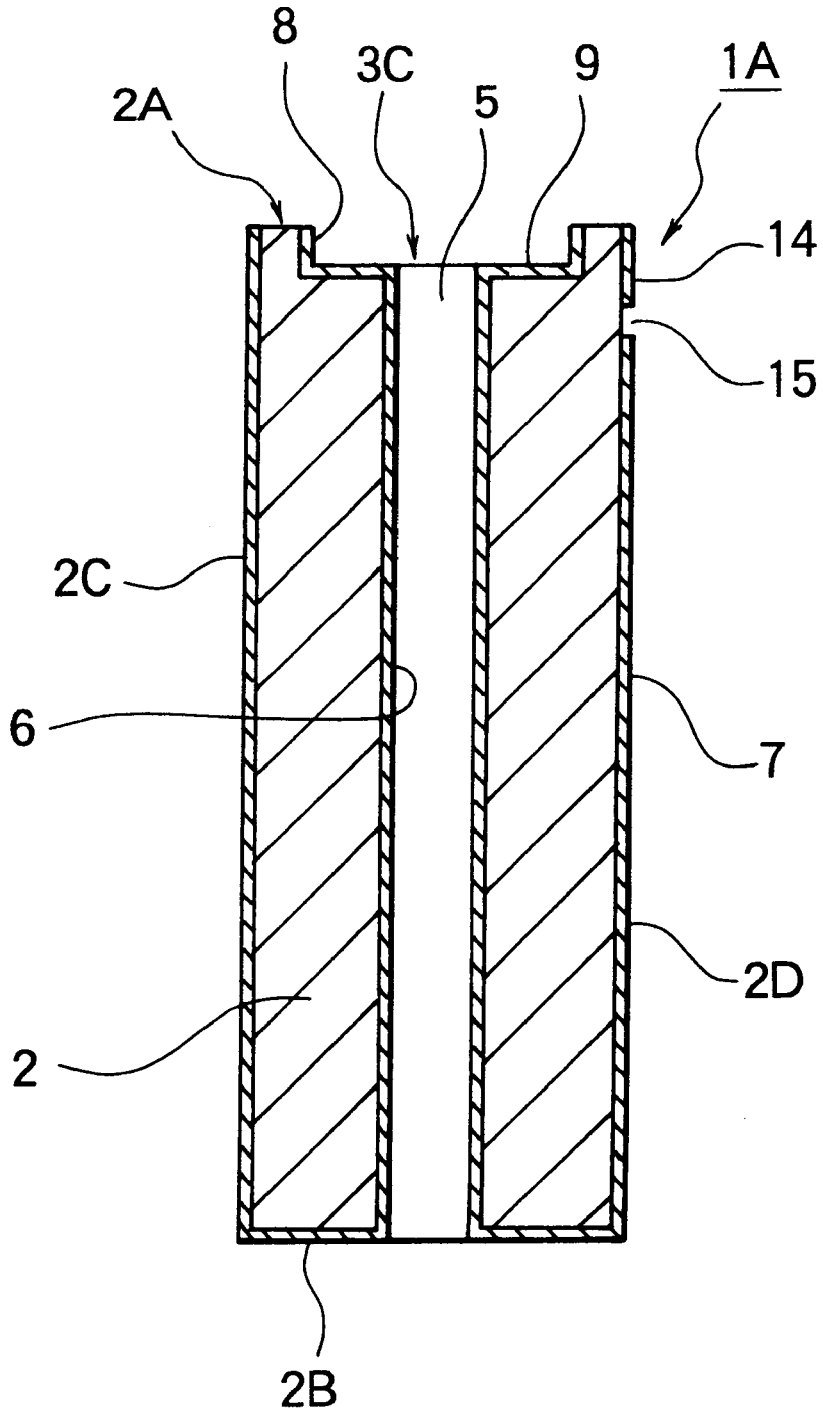
FIG. 6 is a schematic cross sectional view of the dielectric duplexer the of FIG. 3 taken along line A—A.

As shown in FIGS. 4 through 6, the antenna terminal pad 14 is located closer to the transmitting section T than to the receiving section R along the open-circuit end surface 2A of the dielectric ceramic block 2. Therefore, the innermost resonator 3C of the transmitting section T is located very close to the antenna terminal pad 14 to increase the coupling capacitance Ct, whereas the innermost resonator 4A of the receiving section R is located relatively away from the antenna terminal pad 14 to lower the coupling capacitance Cr.

Figure 7:
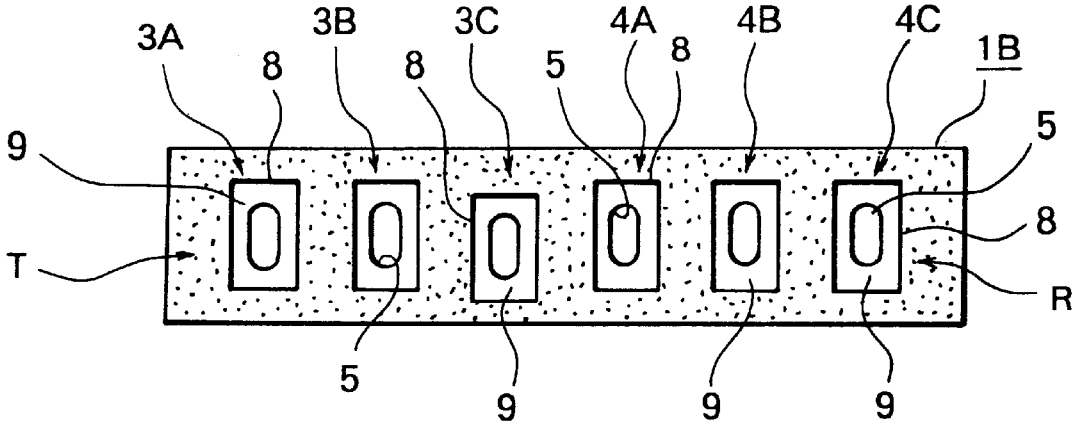
FIG. 7 is a schematic front view showing a dielectric duplexer according to a second embodiment of the present invention.
Figure 8:
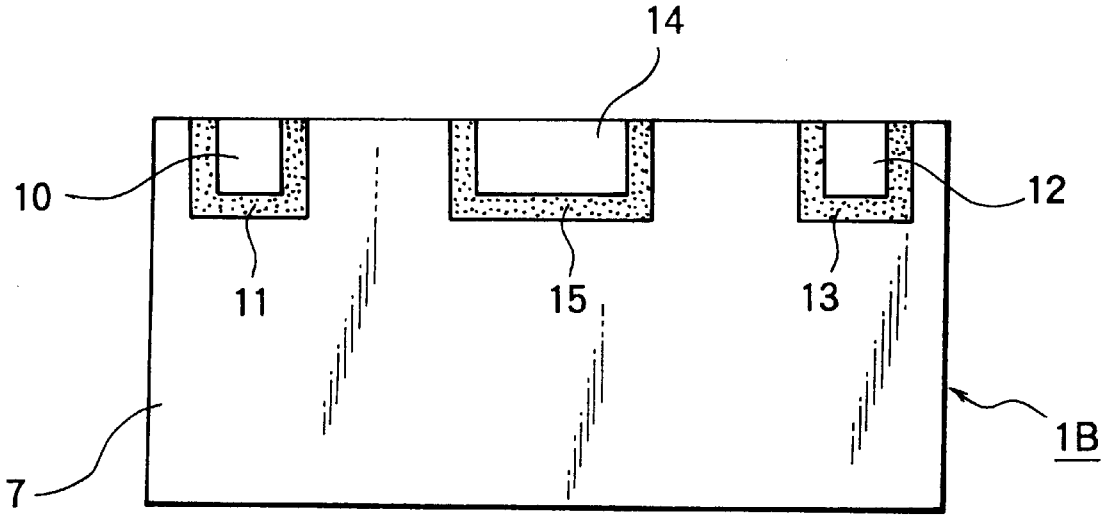
FIG. 8 is a schematic bottom view of the dielectric duplexer of FIG. 7.

In FIGS. 7 and 8 there is shown a dielectric duplexer 1B according to a second embodiment of the present invention in which the innermost resonator 3C of the transmitting section T is displaced from the remaining resonators in a direction perpendicular to the line connecting the centers of the remaining resonators toward the bottom surface 2D side of the dielectric ceramic block 2 where the antenna terminal pad 14 is located Therefore, the innermost resonator 3C of the transmitting section T is located very close to the antenna terminal pad 14 to increase the coupling capacitance Ct. In this case the antenna terminal pad 14 is positioned on the bottom surface 2D of the dielectric ceramic block 2 so that it is opposite equally to both the resonator 3C of the transmitting section T and the resonator 4A of the receiving section R.

Figure 9:
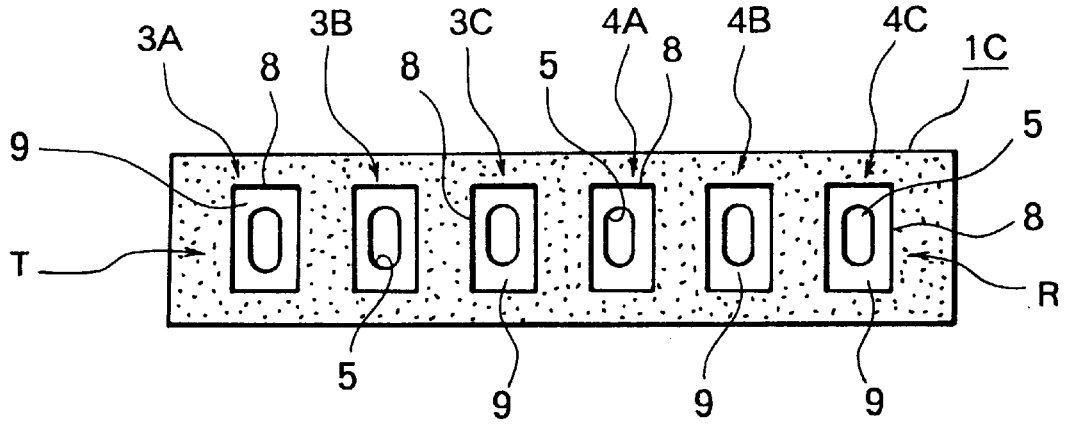
FIG. 9 is a schematic front view showing a dielectric duplexer according to a third embodiment of the present invention.
Figure 10:
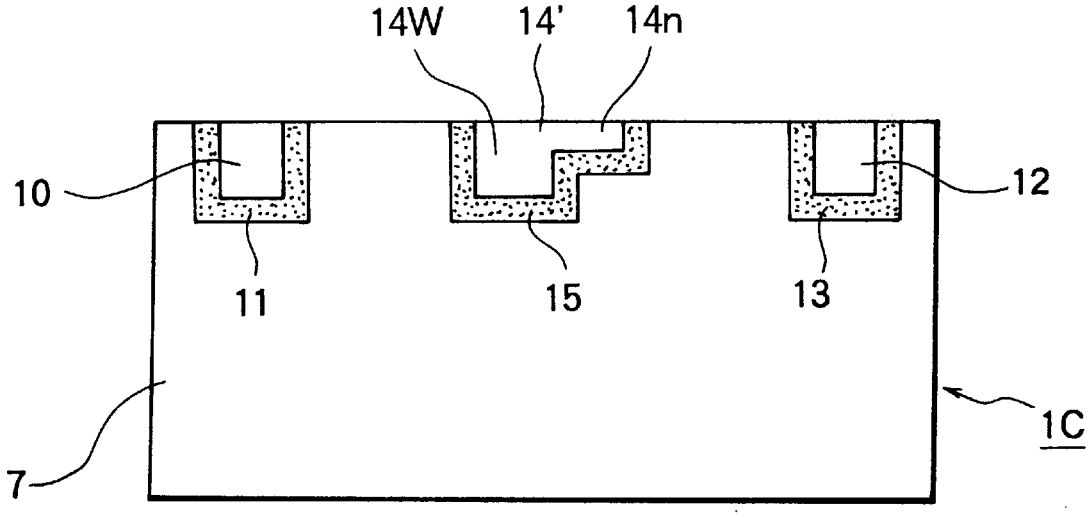
FIG. 10 is a schematic bottom view of the dielectric duplexer of FIG. 9.

FIGS. 9 and 10 illustrate a dielectric duplexer 1C according to a third embodiment of the present invention. The antenna terminal pad 14' is provided with an enlarged portion 14*w* located closer to the transmitter section T and a narrowed portion 14*n* located closer to the receiving section R. Therefore, the coupling capacitance Ct between the innermost resonator 3C of the transmitting section T and the antenna terminal pad 14' is greater than the coupling capacitance Cr between the innermost resonator 4C of the receiving section R and the antenna terminal pad 14'. In this embodiment the resonators 3A through 3C and 4A through 4C are arranged in a line in the same manner as the first embodiment.

Figure 11:
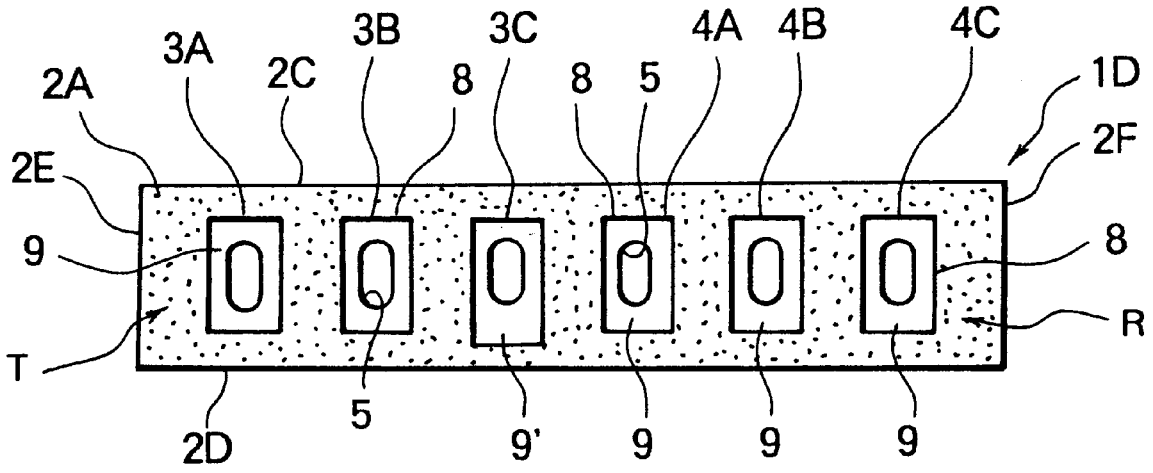
FIG. 11 is a schematic front view showing a dielectric duplexer according to a fourth embodiment of the present invention.

FIG. 11 illustrate a dielectric duplexer 1D according to the fourth embodiment of the present invention. The resonators 3A through 3C and 4A through 4C are arranged in a line in the same manner as the first embodiment. The internal conductor 6 of the each resonator is electrically connected to the spread conductor 9 which is provided on the open-circuit end surface 2A of the dielectric ceramic block 2 for capacitively coupling the adjacent resonators to each other. In this embodiment, the spread conductor 9' for the resonator 3C of the transmitting section T is extended closer to the edge portion between the open-circuit end surface 2A and the bottom surface 2D of the dielectric ceramic block 2 in order that the coupling capacitance Ct between the innermost resonator 3C of the transmitting section T and antenna terminal pad 14 becomes greater than the coupling capacitance Cr between the innermost resonator 4C of the receiving section R and the antenna terminal pad 14.

Thus, the relationship of Ct>Cr holds true in all the above described embodiments to reduce the return loss in both the transmitting section T and the receiving section R to improve the characteristic of the dielectric duplexer.

The dielectric duplexer according to the invention is completely different from any conventional dielectric duplexers comprising a wave-dividing resonator arranged between the transmitting section and the receiving section to capacitively couple the wave-dividing resonator and the antenna terminal pad. Thus, the dielectric duplexer according to the invention has a fewer number of resonators than the conventional dielectric duplexer shown in FIG. 1 so that the dielectric ceramic block 2 of the dielectric duplexer according to the invention can be dimensionally reduced in the direction along which resonators are arranged and hence it is adapted to down-sizing.

In the illustrated embodiments, the resonators 3A through 3C and 4A through 4C may have a circular or rectangular cross section instead of an elliptic cross section as illustrated in the drawings. Thus, a variety of different cross section may be conceivable to those skilled in the art for the resonators of the dielectric duplexer according to the present invention without departing from the scope of the invention.

In the illustrated dielectric duplexer 1A, 1B, 1C or 1D comprising a dielectric ceramic block and a plurality of resonators arranged in a direction in the dielectric ceramic block, a half of the resonators constituting a transmitting section T, the remaining half of the resonators constituting a receiving section R, an antenna terminal pad 14 or 14' is capacitively coupled to the innermost receiver 3C of the transmitting section T and to the innermost resonator 4A of the receiving section R located adjacent to the resonator 3C to eliminate the use of a wave-dividing resonator. Therefore, the dielectric ceramic block 2 of the dielectric duplexer according to the invention can be dimensionally reduced in the direction along which resonators are arranged and hence it is adapted to down-sizing.

Additionally, the coupling capacitance Ct of the antenna terminal pad 14 and the transmitting section T is made greater than the coupling capacitance Cr between the antenna terminal pad 14 and the receiving section R.

Therefore, the return loss is reduced in both the transmitting section T and the receiving section R to improve the signal transmitting performance and the signal receiving performance of the dielectric duplexer.

I claim:

1. A dielectric duplexer comprising:

a dielectric ceramic block;

a plurality of juxtaposed resonators provided in the dielectric ceramic block, which include through holes extended through the dielectric ceramic block sequentially along a direction and internal conductors covering the inner peripheral surfaces of the through holes, the resonators being divided into a group of resonators located near a lateral side of the dielectric ceramic block and operating as a transmitting section and another group of resonators located near the opposite lateral side of the dielectric ceramic block and operating as a receiving section;

an external conductor covering the outer peripheral surface of the dielectric ceramic block except the open-circuit end surface on which one end of each through hole is exposed;

a first input/output pad arranged on the dielectric ceramic block and electrically isolated from the external conductor but capacitively coupled to the outermost resonator of the transmitting section;

a second input/output pad arranged on the dielectric ceramic block and electrically isolated from the external conductor but capacitively coupled to the outermost resonator of the receiving section; and an antenna terminal pad arranged only on a side surface of the dielectric ceramic block, electrically isolated from the external conductor, and capacitively coupled through the block to the innermost resonator of the transmitting section and the innermost resonator of the receiving section located adjacent to the innermost resonator of the transmitting section, respectively, the antenna terminal pad, the innermost resonator of the transmitting section and the innermost resonator of the receiving section being relatively positioned to each other, and the capacitive coupling between the antenna terminal pad and the innermost resonator of the transmitting section being of greater value than the capacitive coupling between the antenna terminal pad and the innermost resonator of the receiving section.

2. A dielectric duplexer according to claim 1, wherein the antenna terminal pad is arranged closer to the transmitting section than to the receiving section.

3. A dielectric duplexer according to claim 1, wherein the innermost resonator of the transmitting section is displaced from the remaining resonators of the transmitting section in a direction perpendicular to a line connecting the centers of the remaining resonators of the transmitting section toward the surface of the dielectric ceramic block where the antenna terminal pad is located.

4. A dielectric duplexer according to claim 1, wherein the antenna terminal pad includes an enlarged portion located closer to the transmitter section than to the receiving station.

5. A dielectric duplexer according to claim 1, wherein each of the resonators has a coupling member on the open-circuit end surface of the dielectric ceramic block, for coupling the adjacent resonators to each other.

6. A dielectric duplexer according to claim 5, wherein the coupling member of the innermost resonator of the transmitting section and the coupling member of the innermost resonator of the receiving section are separated by a distance which reduces coupling capacitance between them.

7. A dielectric duplexer according to claim 5, wherein the coupling member of the innermost resonator of the transmitting section is extended closer to the antenna terminal pad than the coupling member of the innermost resonator of the receiving section.

* * * * *